United States Patent [19]

Takahashi

[11] 4,304,748

[45] Dec. 8, 1981

[54] METHOD OF FINISHING A SLIDE FASTENER CHAIN

[75] Inventor: Kihei Takahashi, Uozu, Japan

[73] Assignee: Yoshida Kogyo K.K., Tokyo, Japan

[21] Appl. No.: 86,247

[22] Filed: Oct. 18, 1979

[30] Foreign Application Priority Data

Oct. 24, 1978 [JP] Japan ..... 53-130812

[51] Int. Cl.[3] ..... B29D 5/00

[52] U.S. Cl. ..... 264/230; 264/280; 425/814

[58] Field of Search ..... 264/230, 280; 425/814

[56] References Cited

U.S. PATENT DOCUMENTS 3,086,246 4/1963 Stone ..... 264/280

3,176,637 4/1965 MacFee ..... 264/280

FOREIGN PATENT DOCUMENTS 262748 6/1970 U.S.S.R. ..... 425/418

*Primary Examiner*—James H. Derrington

*Attorney, Agent, or Firm*—Robert E. Burns; Emmanuel J. Lobato; Bruce L. Adams

[57] ABSTRACT

A method is disclosed whereby a pair of stringers for slide fasteners are subjected to heat treatment to permit the fibers of stringer tapes to be contracted particularly in the region of longitudinal edge portions of the tapes where rows of fastener elements are secured. The thus contracted tape edges are further shaped by compression molding so as to present a transverse cross section complimentary with that of a guide channel in a slider.

4 Claims, 5 Drawing Figures

METHOD OF FINISHING A SLIDE FASTENER CHAIN

BACKGROUND OF THE INVENTION

1. Field of the Invention

This invention relates to a method of finishing slide fastener stringers of continuous length or "fastener chains" having a continuous plastic filament spirally formed and secured to an edge of a stringer tape during the weaving or knitting thereof.

2. Prior Art

There have been proposed a number of slide fasteners or zippers of the type described, which comprise a woven or knitted stringer tape and a coupling fastener element made of a plastic filament anchored into a longitudinal edge of the tape, the filament being usually formed into a helical coil structure consisting of a row of successive elongated loops or convolutions each having a coupling head, an upper and a lower leg and a connecting portion.

When the filament is formed into a row of helically coiled coupling loops and mounted on a stringer tape, such loops would usually present a cross-sectionally oval shape which is not complimentary with the inner guide surfaces of a slider and hence would often interfere with the sliding movement of the latter during opening and closing of the fastener stringers. With a view to eliminating this difficulty, it has been proposed to cover the coupling loops with covering threads over their upper and lower surfaces including their heel portions in such a manner that the covered portions of the loops present a transverse cross section complimentary in shape with the guide channel of the slider. Tape thread systems woven or knitted are susceptible to deformation as they tend to expand or contract upon weaving or knitting of the tape. The rows of fastener elements (coupling loops) mounted on such dimensionally unstable tape would of necessity become shifted out of position relative to each other and displaced or separated from the tape. Furthermore, the covering threads disposed over the fastener elements are rather soft and bulky in nature which in turn creates an increase in the resistance of the covering threads to sliding movement of the slider, resulting in disagreeable, sometimes interrupted coupling or uncoupling engagement of the cooperating stringers.

SUMMARY OF THE INVENTION

According to the invention, there is provided the manufacture of a slide fastener chain having a pair of stringer tapes coupled together and a row of coupling fastener elements secured by a binding thread system to a longitudinal edge of each of said tape, the method which comprises transporting said fastener chain unidirectionally at a constant rate of speed; passing said chain through a first treatment zone where said chain is heated at a temperature to permit the fibers of said stringer tapes to become thermally contracted; subsequently introducing said chain into a second treatment zone where said chain is further heated and compression-molded whereby said binding thread system is plastically deformed to assume a transverse cross section substantially identical with that of a slider guide channel; and cooling said chain to cure.

It is therefore a primary object of the present invention to eliminate the foregoing difficulties encountered by the prior art woven or knitted fasteners.

A more specific object of the invention is to provide a method of finishing a slide fastener chain whereby the fastener element is highly stabilized in position relative to the tape and a tape edge carrying the element is shaped so as to facilitate movement of a slider therealong with least resistance.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION OF THE PREFERRED EMBODIMENT

Figure 1:
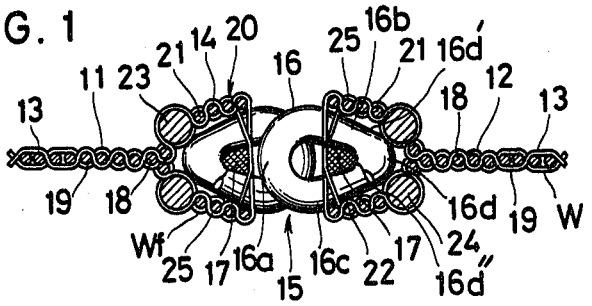
FIG. 1 is a transverse cross-sectional view of a slide fastener chain with a pair of stringers coupled together.

Referring now to the drawings and FIG. 1 in particular, there is shown in its transverse cross-section a slide fastener chain 10 comprising a pair of stringers 11,12 having a woven support tape structure. Each of the stringers 11,12 consists of a generally flat web section W defining a major dimension of a woven tape 13 and a woven filament section $W_f$ defining a longitudinal edge portion 14 into which a filament 15 of plastic material is woven. The filament 15 is formed from a linear blank of a suitable plastic material into a helically coiled structure having a succession of loops or elongated convolutions 16 during the course of weaving of the tape 13.

Each loop or elongated convolution 16 in the filament 15 has a coupling head **16*a* at one end thereof, an upper leg 16*b* and a lower leg 16*c* extending from the head 16*a* in a common direction and a heel portion 16*d* remote from the head 16*a* connected to a next adjacent one of the successive loops 16. The coupling head 16*a* is dimensioned to releasably couple with a corresponding head of a loop 16 on a mating stringer to open and close the fastener in the well known manner. The upper and lower legs 16*b* and 16*c* are spaced in substantially superimposed relation to each other and define therebetween a longitudinally extending "tunnel" or hollow conduit through which a reinforcing string, cord or core 17** is inserted.

The web section W of the tape 13 may be of any known design having foundation warp threads 18 and foundation weft thread 19 interwoven in a variety of patterns.

The term "filament woven section $W_f$" is used to define a longitudinal edge portion of the tape 11 into which the filament 15 serving as a coupling element for a slide fastener is woven. The row of coupling loops 16 is secured to the filament woven section $W_f$ by a binding system 20 which comprises a first group of binding warp threads 21, a second group of binding warp threads 22, a plurality of relatively large diameter thermoplastic binding yarns 23,24 and a binding weft thread 25 which is a continuous portion of the foundation weft thread 19.

The first group of binding warp threads 21 extend longitudinally of the stringer tape 13,(13) and overlie the upper legs **16*b* of successive loops 16 adjacent to the heel portions 16*d*. The second group of binding warp threads 22 extend longitudinally of the stringer tape 13,(13) and underlie the lower legs 16*c* of successive loops 14 adjacent to the heel portions 61*d*. One of the thermoplastic binding yarns 23,(24) extends longitudinally of the stringer tape 13,(13) in abutting engagement with the upper surface 16*d*' of the heel portion 16*d* of each loop 16, and the other binding yarn 24 extends longitudinally of the stringer tape 13,(13) in abutting engagement with the lower surface 16*d*'' of the heel portion 15*d*. The binding weft thread 25 is passed around and in interlaced relation to the first and second groups of binding warp threads 21,22 and the thermoplastic binding yarns 23,24 and bind all of these warp materials together into an integral binding system securing the row of coupling loops 16 via cord 17 to the woven filament section $W_f$ of the tape 13,(13). The binding thread system 20, as it is disposed by weaving over the fastener element 15, is dimensionally unstable and loosely connected to the filament 15, and the fastener chain 10** with such structure is not satisfactory for reasons mentioned at the outset of this specification.

Figure 2:
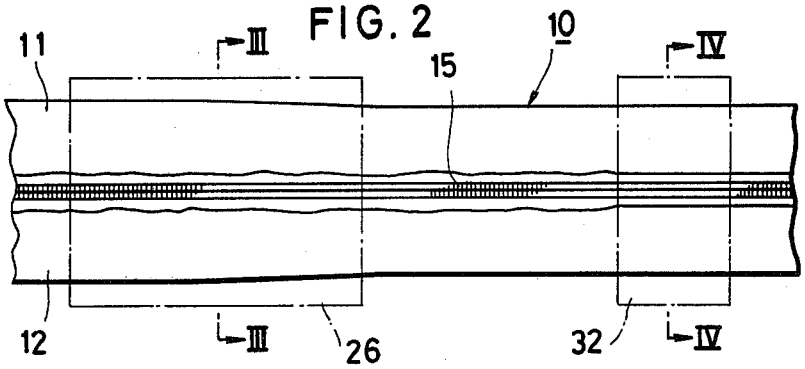
FIG. 2 is a schematic plan view of a slide fastener chain.
Figure 3:
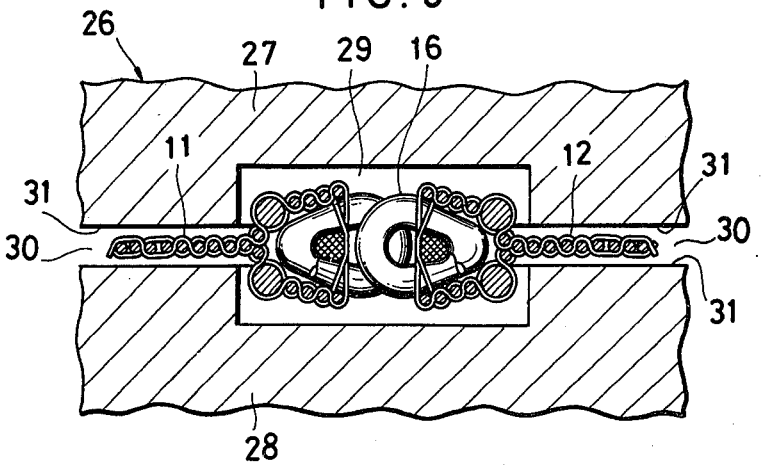
FIG. 3 is a view similar to FIG. 1 but showing the fastener chain being pretreated.

According to the invention, the fastener chain 10 is transported unidirectionally at a constant rate of speed as shown in FIG. 2 and introduced, while in travel, into a first treatment zone where the chain 10 is thermally preset. There is provided a heater 26 at the first treatment zone which comprises, as schematically shown in FIG. 3, a pair of upper and lower heating blocks 27,28 which are spaced apart to define an opening for passage therethrough of the fastener chain 10. The blocks 27,28 each are centrally recessed to form a flange-like structure and define therebetween a substantially rectangular guide channel 29 which is dimensioned to receive the filament woven section $W_f$ of two interengaged stringers 11,12 including the filament 16, in which instance the woven section $W_f$ is spaced a predetermined distance apart from the inner peripheral walls of the heating blocks 27,28 to avoid over-heat. Communicating with the rectangular guide channel 29 are a pair of elongated slits 30 formed at opposite sides of the channel 29 between flat sole portions 31 of the respective blocks for receiving the web section W of the woven tapes 13 with clearance to avoid overheat. Heat-treatment conditions employed at the first treatment zone are variable with the material of the fastener tape. With a polyester textured yarn, the fastener chain 10 may be heated at about 200° C. for about 28 seconds. For nylon tapes, it may be about 130° C. Under these conditions, the fastener chain 10 is heated on passage through the heater 26 whereupon the fibers of the tape threads, the binding system 20 in particular, are contracted in contact with high temperature atmosphere created within the guide channel 29 and the slits 30. The threads in the binding system 20 are thus thermally contracted thereby rendering the system 20 tight and firm so that the coupling loops 16 of the fastener element (filament) 15 are stabilized in their posture and position relative to the tapes 13 and maintained in the correct element pitch. Heat treatment also serves to eliminate irregularities which may have developed in the tape system as a whole during weaving thereof.

Figure 4:
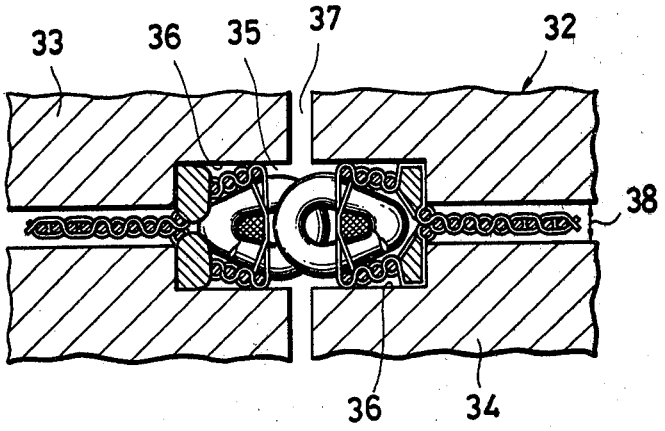
FIG. 4 is a transverse cross-sectional view of the fastener chain which has been shaped and thermally set.
Figure 5:
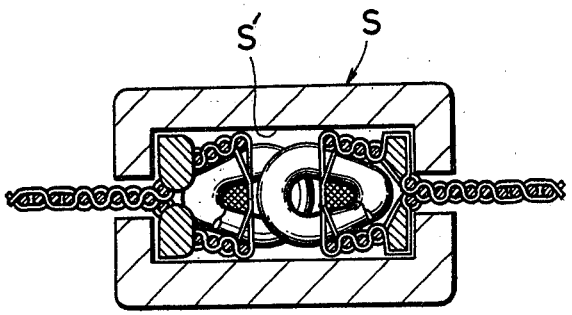
FIG. 5 is a view similar to FIG. 4 but showing the fastener chain threaded through a slider.

The fastener chain 10 thereafter enters into a second treatment zone provided in the path of its travel where the chain 10 is subjected to thermal compression molding. In the second treatment zone, there is provided a shaping die 32 comprising a pair of upper and lower die blocks 34,34 defining therebetween a substantially rectangular guide channel 35 which is smaller than the channel 29 in the heater as shown in FIG. 4. The woven filament section $W_f$ of each of the coupled stringers 11,12 is compressed by the working surfaces 36 of the die 32 which are heated to a temperature similar to that in the heater 26. Upon compression, the mass of the threads in the system 20 is plastically deformed to assume a transverse cross section substantially identical with that of a guide channel S' of a slider S as shown in FIG. 5. Plastically deformed mass of the threads in the binding system 20 penetrates into the spaces defined by the heel portions **16*d* between each adjacent pair of loops 16 and joins adjacent heel portions 16*d* together, so that the heel portions 16*d*, which would otherwise be movable relative to adjacent ones of successively interconnected loops 16 in a row, are held integrally together. This ensures not only firm fixation of the row of loops 16 to the tape 13, but also smooth sliding movement of the slider S therealong and further effective coupling and uncoupling operation of the paired stringers 11,12 as the neutral zone of each loop 16 which is free of both compressive and tensile stresses is maintained in close proximity to the heel portion 16*d* remote from the coupling head 16*a*** so as to create an increased free area in each loop available for coupling engagement with adjacent loops.

In order to avoid the tendency of the coupling loops 16 getting molten or otherwise deformed at their exposed portions (mostly head portions **16*a*) during compression molding, the upper and lower die blocks 33,34 are each subdivided and spaced apart across a gap 37 which registers with the position of the coupling heads 16*a*** and through which excess heat may dissipate to the outside atmosphere.

An elongated slit 38 in the die 32 should be large enough to avoid deformation by heat of the web section W of the tape 13. It is usually about 2 mm wide for a tape thickness of about 0.5 mm.

The fastener chain 10 thus treated and shaped is cooled to cure. Advantageously, the thermal contraction and molding operation according to the invention may be carried out in a continuous flow of process following the stage of coupling of the stringers.

Although various minor modifications may be suggested by those versed in the art, it should be understood that I wish to embody within the scope of the patent warranted hereon, all such embodiments as reasonably and properly come within the scope of my contribution to the art.

What is claimed is:

1. In the manufacture of a slide fastener chain having a pair of stringer tapes coupled together and a row of filamentary coupling elements having a succession of loops and secured by a binding thread system to a longitudinal edge of each of said tapes, said binding thread system partly covering at least one of upper and lower surfaces of said loops of the coupling element row, the method which comprises the steps of:

(a) transporting said fastener chain unidirectionally at a constant rate of speed;

(b) passing said chain through a first treatment zone where said chain is thermally preset at a temperature to permit the fibers of said stringer tapes and said binding thread system to become thermally contracted;

(c) subsequently introducing said chain into a second treatment zone where said binding thread system of said chain is thermally compressed at a temperature similar to that in said first treatment zone, whereby said binding thread is plastically deformed to assume a transverse cross section substantially identical with that of a slider guide channel; and (d) cooling said chain to set it, said rows of coupling elements being coupled together prior to, and remaining coupled together during, the passing of said chain through said first and second treatment zones.

2. The method as claimed in claim 1, in which said stringer tapes are formed of polyester yarn and the temperature in said first and second treatment zones is about 200° C.

3. The method as claimed in claim 1, in which said stringer tapes are formed of nylon yarn and the temperature in said first and second treatment zones is about 130° C.

4. The method as claimed in any of claims 2, 3 and 1, in which a core cord extends through said loops of said coupling element row and in which said binding thread system comprises a first group of binding warp threads partly covering upper surfaces of said loops of the coupling element row, a second group of binding warp yarns partly covering lower surfaces of said loops of the coupling element row, relatively large diameter thermoplastic binding yarns extending along heel portions of said loops of said coupling element row, and a binding weft-thread binding together said core cord, binding warp threads and thermoplastic binding yarns, said thermoplastic binding yarns being plastically deformed by said thermal compression in said second treatment zone to conform to a slider guide channel and with portions penetrating between heel portions of successive ones of said loops.

* * * * *